US008647182B2

(12) United States Patent
Enzenroth et al.

(10) Patent No.: US 8,647,182 B2
(45) Date of Patent: Feb. 11, 2014

(54) EXHAUST FAN ASSEMBLY

(75) Inventors: John William Enzenroth, Weston, WI (US); Terry Lee Hrdina, Wausau, WI (US); Kishor Kashinath Khankari, Ann Arbor, MI (US); Scott James Koeppel, Wausau, WI (US); Edward G. Legner, Junction City, WI (US); Timothy Ronald Mathson, Mosinee, WI (US); Anthony J. Rossi, Indianapolis, IN (US); Michael Glenn Seliger, Marathon, WI (US)

(73) Assignee: Greenheck Fan Corporation, Schofield, WI (US)

( * ) Notice: Subject to any disclaimer, the term of this patent is extended or adjusted under 35 U.S.C. 154(b) by 253 days.

(21) Appl. No.: 12/728,666

(22) Filed: Mar. 22, 2010

(65) Prior Publication Data

US 2010/0291849 A1 Nov. 18, 2010

Related U.S. Application Data

(63) Continuation of application No. 10/984,052, filed on Nov. 9, 2004, now Pat. No. 7,682,231.

(60) Provisional application No. 60/588,074, filed on Jul. 15, 2004, provisional application No. 60/537,609, filed on Jan. 20, 2004.

(51) Int. Cl.
*F23L 17/02* (2006.01)

(52) U.S. Cl.
USPC ..... 454/16; 454/17

(58) Field of Classification Search
USPC ..... 454/15, 16, 338, 339, 341, 1, 3
See application file for complete search history.

(56) References Cited

U.S. PATENT DOCUMENTS

| | | | |
|---|---|---|---|
| 37,270 | A | 1/1863 | Betts |
| 144,586 | A | 11/1873 | Wingate |
| 297,972 | A | 5/1884 | Day |
| 352,597 | A | 11/1886 | Wohlfert |

(Continued)

FOREIGN PATENT DOCUMENTS

| | | |
|---|---|---|
| CN | 2118836 | 10/1992 |
| CN | 2337453 | 9/1999 |

(Continued)

OTHER PUBLICATIONS

European Supplementary Search Report, EP Application No. 05706002.2, Patent No. 1718870; corresponding to PCT/US2005/001968, dated May 26, 2009.

(Continued)

*Primary Examiner* — Steven B McAllister
*Assistant Examiner* — Brittany E Towns
(74) *Attorney, Agent, or Firm* — Merchant & Gould P.C.

(57) ABSTRACT

An exhaust fan assembly is provided for expelling contaminated air from a building. The assembly includes a plenum, a fan assembly attached to the plenum, and a windband mounted on top of the fan assembly. The fan assembly is constructed of cylindrical outer and inner walls which define a bearing chamber and surrounding annular space. A fan driven by a shaft extending downward from the bearing chamber draws exhaust air from the plenum and blows it up through the annular space to a nozzle at the top of the fan assembly.

11 Claims, 13 Drawing Sheets

(56) References Cited

U.S. PATENT DOCUMENTS

| | | | | |
|---|---|---|---|---|
| 603,881 | A | | 5/1898 | Kuphal |
| 648,801 | A | | 5/1900 | Schubert |
| 736,748 | A | | 8/1903 | Le Beau |
| 852,480 | A | | 5/1907 | Whitehead |
| 1,053,507 | A | | 2/1913 | De Kernia |
| 1,126,348 | A | | 1/1915 | Basman |
| 1,296,040 | A | | 3/1919 | Bontya |
| 1,346,633 | A | | 7/1920 | Cloud |
| 1,394,735 | A | | 10/1921 | Jordan |
| 1,729,152 | A | | 8/1929 | Kiesel, Jr. |
| 1,891,860 | A | | 12/1932 | Woolf |
| 1,986,176 | A | | 1/1935 | Zwerling |
| 1,988,810 | A | | 1/1935 | Ross |
| 2,082,955 | A | | 6/1937 | Hagen |
| 2,188,564 | A | | 1/1940 | Berg |
| 2,265,112 | A | | 12/1941 | Davies |
| 2,269,050 | A | | 1/1942 | Zimmerman |
| 2,294,024 | A | | 8/1942 | McClinton |
| 2,363,733 | A | | 11/1944 | Karol |
| 2,478,761 | A | | 8/1949 | Houseman |
| 2,514,247 | A | | 7/1950 | Leardi et al. |
| 2,551,004 | A | | 5/1951 | Johnson |
| 2,605,693 | A | | 8/1952 | Hansen |
| 2,619,021 | A | | 11/1952 | Pfautsch |
| 2,714,847 | A | | 8/1955 | Svebel |
| 2,777,382 | A | | 1/1957 | Solzman |
| 2,805,615 | A | | 9/1957 | Rudy |
| 2,842,041 | A | | 7/1958 | Burger |
| 2,875,678 | A | | 3/1959 | Wyley |
| 2,973,825 | A | | 3/1961 | Bertin |
| 3,045,579 | A | | 7/1962 | Jenn et al. |
| 3,069,071 | A | * | 12/1962 | Carlson ..... 415/116 |
| 3,087,409 | A | | 4/1963 | Carr |
| 3,102,679 | A | * | 9/1963 | Rudy ..... 417/84 |
| 3,115,820 | A | | 12/1963 | Adelt |
| 3,122,088 | A | | 2/1964 | Patterson |
| 3,194,305 | A | | 7/1965 | Moore |
| 3,209,670 | A | | 10/1965 | Twickler |
| 3,229,896 | A | | 1/1966 | Levy |
| 3,283,694 | A | | 11/1966 | Dean, Jr. |
| 3,285,567 | A | | 11/1966 | Richardson |
| 3,288,377 | A | | 11/1966 | Van de Roer |
| 3,313,228 | A | | 4/1967 | Cook |
| 3,347,147 | A | | 10/1967 | Howard |
| 3,382,792 | A | | 5/1968 | Howard |
| 3,385,197 | A | | 5/1968 | Greber |
| 3,390,401 | A | | 6/1968 | Matsuyoshi et al. |
| 3,537,411 | A | | 11/1970 | Roy |
| 3,584,968 | A | | 6/1971 | Keith |
| 3,650,633 | A | | 3/1972 | Benoit |
| 3,719,032 | A | | 3/1973 | Cash |
| 3,727,566 | A | | 4/1973 | Roy |
| 3,730,073 | A | | 5/1973 | Potter |
| 3,747,505 | A | | 7/1973 | Turko |
| 3,797,373 | A | | 3/1974 | Larson |
| 3,817,162 | A | | 6/1974 | Guelph |
| 3,946,648 | A | | 3/1976 | Schneider |
| 4,095,514 | A | | 6/1978 | Roy et al. |
| 4,184,417 | A | | 1/1980 | Chancellor |
| 4,204,463 | A | | 5/1980 | Carty |
| 4,245,965 | A | | 1/1981 | Brown |
| 4,344,370 | A | | 8/1982 | Smith et al. |
| 4,437,868 | A | | 3/1984 | Kuhlman |
| 4,472,110 | A | | 9/1984 | Sun Keu |
| 4,494,450 | A | | 1/1985 | Avril |
| 4,525,223 | A | | 6/1985 | Tsuya et al. |
| 4,534,281 | A | | 8/1985 | Parks et al. |
| 4,655,121 | A | | 4/1987 | Ludwig |
| 4,682,206 | A | | 7/1987 | Tsuya et al. |
| 4,690,338 | A | | 9/1987 | Sayler et al. |
| 4,742,765 | A | | 5/1988 | Weinert et al. |
| 4,768,424 | A | | 9/1988 | Frenkler et al. |
| 4,806,076 | A | | 2/1989 | Andrews |
| 4,856,420 | A | | 8/1989 | Poblete et al. |
| 4,915,141 | A | | 4/1990 | Nitta et al. |
| 4,922,766 | A | | 5/1990 | Ahn |
| 4,993,314 | A | | 2/1991 | Braden et al. |
| 5,079,464 | A | | 1/1992 | King et al. |
| 5,232,152 | A | | 8/1993 | Tsang |
| 5,261,389 | A | | 11/1993 | Trieb |
| 5,326,317 | A | | 7/1994 | Ishizu et al. |
| 5,439,349 | A | | 8/1995 | Kupferberg |
| 5,447,468 | A | | 9/1995 | Tener et al. |
| 5,556,331 | A | | 9/1996 | Bastian |
| 5,645,483 | A | | 7/1997 | Cushman |
| 5,669,811 | A | | 9/1997 | Zaniewski |
| 5,697,838 | A | | 12/1997 | Morris |
| 5,716,267 | A | | 2/1998 | Hambleton et al. |
| 5,797,790 | A | | 8/1998 | Rindoks et al. |
| 6,053,162 | A | | 4/2000 | Godfree et al. |
| 6,112,850 | A | | 9/2000 | Secrest et al. |
| 6,230,723 | B1 | | 5/2001 | Hixson |
| 6,278,248 | B1 | | 8/2001 | Hong et al. |
| 6,302,779 | B1 | | 10/2001 | Ryan et al. |
| 6,336,338 | B1 | | 1/2002 | Koren |
| 6,428,408 | B1 | | 8/2002 | Bell et al. |
| 6,431,974 | B1 | | 8/2002 | Tetley et al. |
| 6,461,233 | B1 | | 10/2002 | Gilkison et al. |
| 6,582,292 | B1 | | 6/2003 | Bastian |
| 6,659,857 | B2 | | 12/2003 | Ryan et al. |
| 6,676,503 | B2 | | 1/2004 | Hill et al. |
| 6,814,661 | B2 | | 11/2004 | Jardinier |
| 6,871,170 | B2 | | 3/2005 | Ryan et al. |
| 7,018,287 | B2 | | 3/2006 | Kupferberg et al. |
| 7,682,231 | B2 | | 3/2010 | Enzenroth et al. |
| 2003/0114098 | A1 | | 6/2003 | Hill et al. |
| 2004/0146821 | A1 | | 7/2004 | Joshi |

FOREIGN PATENT DOCUMENTS

| | | | |
|---|---|---|---|
| DE | 844 498 | | 7/1952 |
| DE | 2719 100 | | 11/1978 |
| EP | 0057102 | | 8/1982 |
| EP | 0751348 | | 1/1997 |
| FR | 732348 | | 9/1932 |
| FR | 1173612 | | 12/1959 |
| FR | 2117427 | | 7/1972 |
| FR | 2831945 | | 5/2003 |
| GB | 507787 | | 6/1939 |
| GB | 610 153 | | 10/1948 |
| GB | 1448202 | | 9/1976 |
| GB | 2091861 | A | 8/1982 |
| JP | 59038526 | A | 3/1984 |
| WO | WO01/73348 | | 10/2001 |

OTHER PUBLICATIONS

Attached Appendix A (Figure 2 in US 2003/0114098 A1 with examiner's annotations), 2003.
Attached Appendix B (Figure 5 in US 2003/0114098 A1 with examiner's annotations), 2003.
TB Wood's, Flexible Couplings, Brochure, 2003.

* cited by examiner

FIG. 9
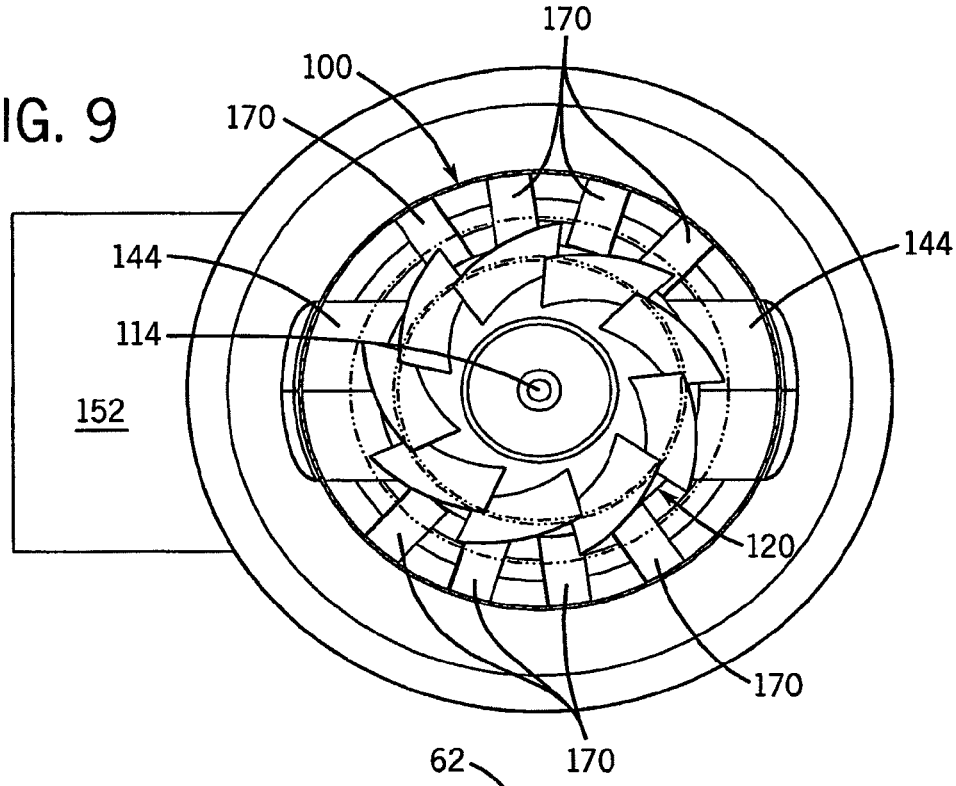
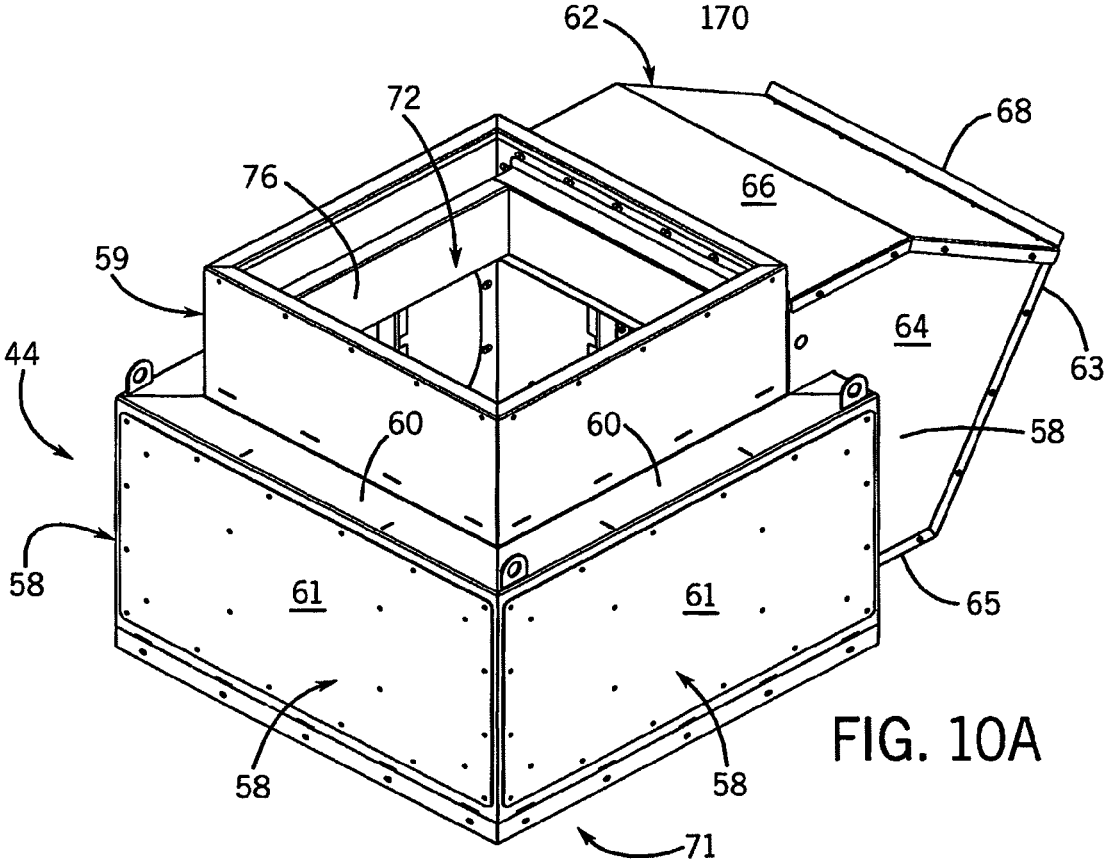
FIG. 10A

EXHAUST FAN ASSEMBLY

CROSS-REFERENCE TO RELATED APPLICATIONS

This application is a continuation of U.S. patent application Ser. No. 10/984,052, filed Nov. 9, 2004, which claims the benefit of U.S. Provisional Patent Application Ser. No. 60/588,074, filed Jul. 15, 2004, and which claims the benefit of U.S. Provisional Patent Application Ser. No. 60/537,609, filed Jan. 20, 2004, which applications are hereby incorporated by reference in their entireties.

BACKGROUND OF THE INVENTION

The present invention relates generally to exhaust fans, and more particularly to exhaust fans of the type that draw contaminated air from one or more fume hoods dispersed throughout a building, mix the contaminated air with ambient air to dilute the contaminants, and vent the diluted air from the building into the ambient environment.

There are many different types of exhaust systems for buildings. In most of these the objective is to simply draw air from inside the building in an efficient manner. In building such as laboratories, fumes are produced by chemical and biological processes, which may have an unpleasant odor, are noxious or toxic. One solution to rid the building of these fumes is to exhaust them through a tall exhaust stack which releases the fumes far above ground and roof level. Such exhaust stacks, however, are expensive to build and are unsightly.

Another solution is to mix the fumes with fresh air to dilute the contaminated air, and exhaust the diluted air upward from the top of the building at a high velocity. The exhaust is thus diluted and blown high above the building. Examples of such systems are described in U.S. Pat. Nos. 4,806,076; 5,439,349 and 6,112,850. Prior systems are expensive, difficult to safely maintain and not easily adaptable to meet a wide range of performance specifications.

BRIEF SUMMARY OF THE INVENTION

The present invention is an exhaust fan assembly for receiving exhaust air from a building at an air inlet, mixing the exhaust air with ambient air, and blowing the mixed air upward to a substantial plume height above an air outlet. The exhaust fan assembly includes: an outer enclosed wall that defines a substantially cylindrical cavity therein; an air inlet formed at the bottom of the cylinder cavity; an inner enclosed wall fastened to the outer enclosed wall and positioned in the cylindrical cavity to divide it into a centrally located bearing chamber and a surrounding, annular space, the inner enclosed wall being spaced upward from the air inlet to form a fan chamber at the bottom of the cylindrical cavity; a shaft rotatably mounted to the inner enclosed wall and extending downward into the fan chamber; a fan wheel attached to the shaft and disposed in the fan chamber to draw exhaust air in through the air inlet and blow it upward through the annular space; and a motor coupled to the shaft in the bearing chamber for rotating the fan wheel.

The inner and outer walls are shaped at their upper ends such that the area of the annular space is substantially reduced to form a nozzle which increases the velocity of the exhaust air blown therethrough. In a first preferred embodiment the inner wall is flared radially outward at its upper end to form the nozzle and in a second embodiment the upper end of the outer wall is tapered inward to form the nozzle.

The bearing chamber is completely isolated from the exhaust stream, thus protecting the fan drive components from corrosive gases. An access opening formed by a passage wall which bridges between the outer and inner walls provides access to the bearing chamber from outside the fan assembly to enable safe inspection and maintenance of the fan drive components even while the fan is operating. In one embodiment the motor is mounted inside the bearing chamber and connected directly to the fan shaft, and in a second embodiment the motor is mounted outside the fan assembly and is coupled to the fan shaft by a belt drive that extends through the access opening.

To insure there is no leakage of exhaust air into the bearing chamber, the fan wheel includes auxiliary blades which create a negative pressure relative to the inside of the bearing chamber. Thus, if there is any leakage, for example, around the fan shaft or its supporting bearing, exhaust air cannot flow into the bearing chamber.

Another aspect of the present invention is the mixing of ambient air with the exhaust air such that the exhaust air is substantially diluted in the plume. This is accomplished in a number of ways. First, the fan assembly is mounted on a plenum which receives the exhaust air from the building, mixes it with ambient air flowing into the plenum through a controlled damper, and delivers the mixed air to the air inlet on the bottom of the fan assembly. The damper is controlled to maintain a relatively constant flow of air through the fan assembly despite variation in the amount of air exhausted from the building. In this manner the plume height can be maintained despite a reduction in exhaust air from the building that would otherwise require a change in fan speed.

To further dilute the exhaust air with ambient air a windband is mounted above the fan assembly and around the nozzle. The windband is frustum-shaped having a circular opening at is bottom which surrounds the nozzle and defines an annular-shaped air inlet therebetween. Ambient air is drawn in through this inlet to mix with exhaust air exiting the nozzle at high velocity before being exhausted through a smaller, circular exhaust opening at the top of the windband. To improve the efficiency of this mixing process, the bottom edge of the windband is flared outward and its upper edge is formed into a cylindrical ring.

To further dilute the exhaust air with ambient air the top end of the inner wall is open and ambient air is drawn in through access openings and upward through these openings to mix with air exhausted from the nozzle. In the preferred embodiment two access openings are formed on opposite sides of the fan assembly to provide better access to the bearing chamber and increased ambient air flow.

In the following description, reference is made to the accompanying drawings, which form a part hereof, and in which there is shown by way of illustration, and not limitation, a preferred embodiment of the invention. Such embodiment also does not define the scope of the invention and reference must therefore be made to the claims for this purpose.

BRIEF DESCRIPTION OF THE DRAWINGS

Reference is hereby made to the following drawings in which like reference numerals correspond to like elements throughout, and in which:

FIG. 9 is a view in cross-section taken along the plane 9-9 shown in FIG. 3;

FIG. 10A is a perspective view of the plenum which forms part of the exhaust fan assembly of FIG. 2 with parts removed;

DETAILED DESCRIPTION OF THE PREFERRED EMBODIMENT

Figure 1:
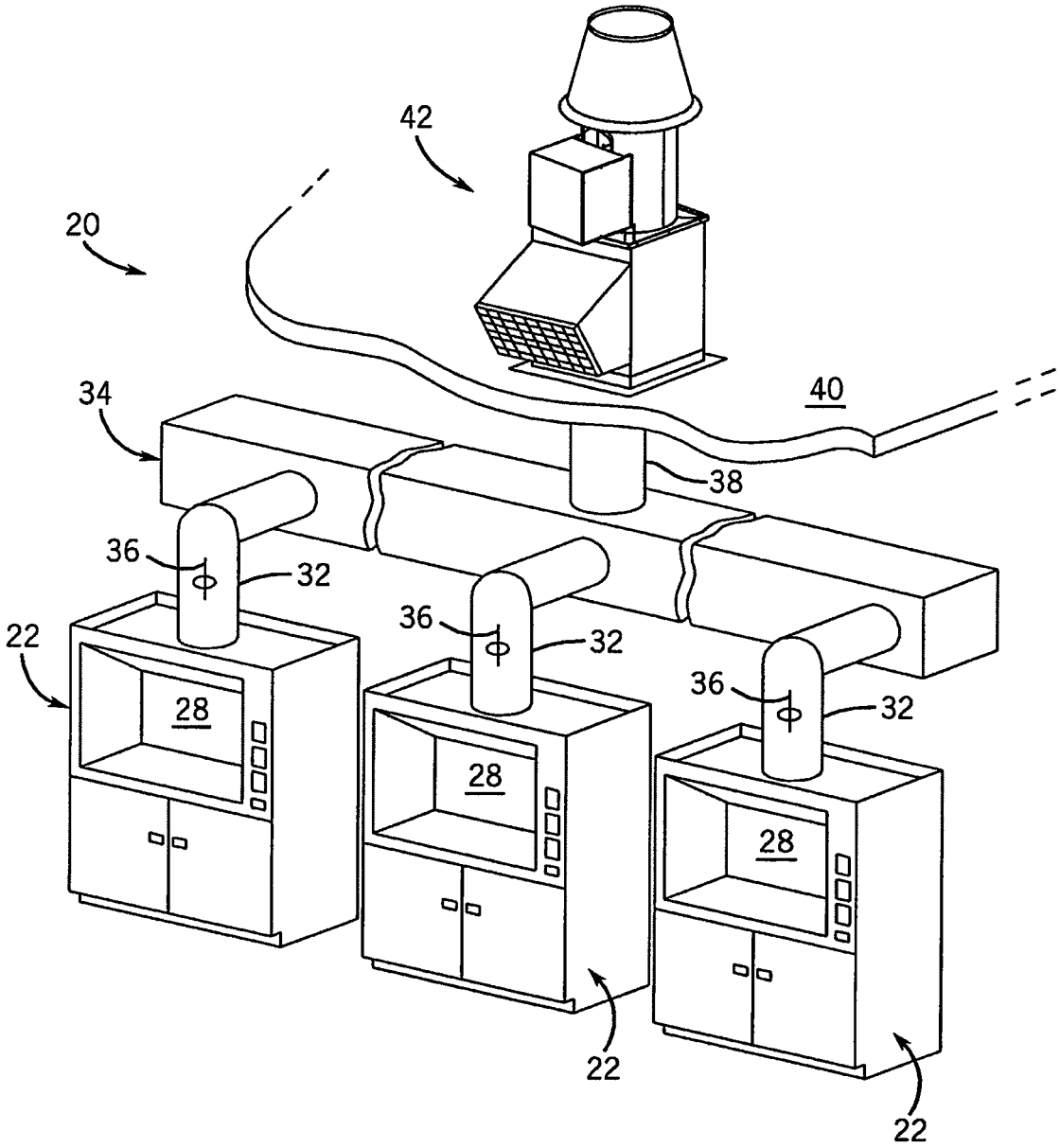
FIG. 1 is a schematic perspective view of a building ventilation system constructed in accordance with principles of the present invention.

Referring initially to FIG. 1, a building ventilation system 20 includes one or more fume hoods 22 of the type commonly installed in commercial kitchens, laboratories, manufacturing facilities, or other appropriate locations throughout a building that create noxious or other gasses that are to be vented from the building. In particular, each fume hood 22 defines a chamber 28 that is open at a front of the hood for receiving surrounding air. The upper end of chamber 28 is linked to the lower end of a conduit 32 that extends upwardly from the hood 22 to a manifold 34. Manifold 34 is further connected to a riser 38 that extends upward to a roof 40 or other upper surface of the building. The upper end of riser 38 is, in turn, connected to an exhaust fan assembly 42 that is mounted on top of roof 40 and extends upwardly away from the roof for venting gasses from the building.

Figure 2:
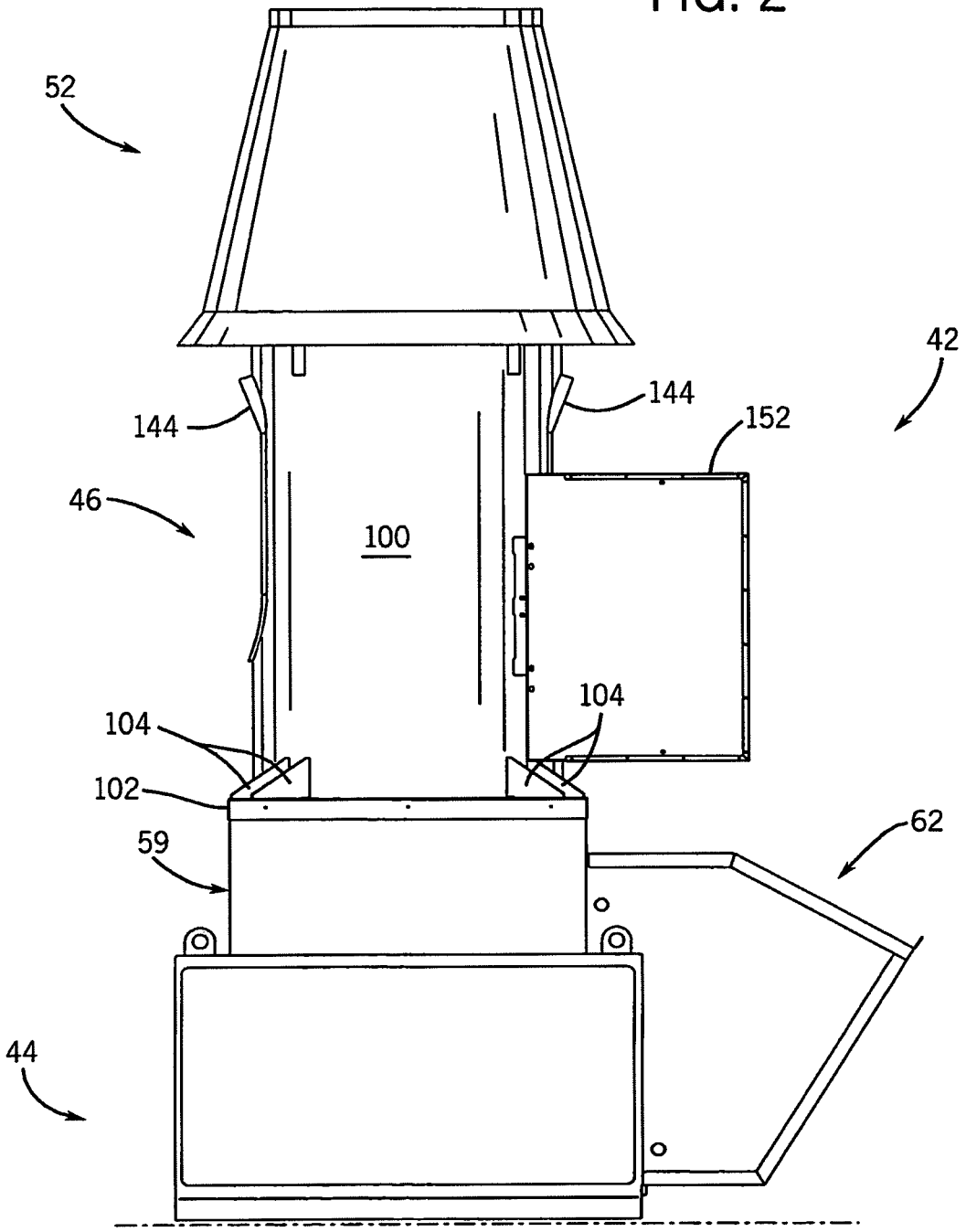
FIG. 2 is a side elevation view of an exhaust fan assembly in accordance with the preferred embodiment.

The exhaust fan assembly 42 is illustrated in FIG. 2 and includes a plenum 44 disposed at the base of the assembly that receives exhaust from riser 38 and mixes it with fresh air. A fan assembly 46 is connected to, and extends upwardly from, plenum 44. Fan assembly 46 includes a fan wheel that draws exhaust upward through the plenum 44 and blows it out through a windband 52 disposed at its upper end. Each of these components is described in more detail below. During operation, exhaust fan assembly 42 draws an airflow that travels from each connected fume hood 22, through chamber 28, conduits 32, manifold 34, riser 38 and plenum 44. This exhaust air is mixed with fresh air before being expelled upward at high velocity through an opening in the top of the windband 52.

The control of this system typically includes both mechanical and electronic control elements. A conventional damper 36 is disposed in conduit 32 at a location slightly above each hood 22, and is automatically actuated between a fully open orientation (as illustrated) and a fully closed orientation to control exhaust flow through the chamber 28. Hence, the volume of air that is vented through each hood 22 is controlled.

The building can be equipped with more than one exhaust fan assembly 42, each such assembly 42 being operably coupled either to a separate group of fume hoods 22 or to manifold 34. Accordingly, each exhaust fan assembly 42 can be responsible for venting noxious gasses from a particular zone within the building, or a plurality of exhaust fan assemblies 42 can operate in tandem off the same manifold 34. In addition, the manifold 34 may be coupled to a general room exhaust in building. An electronic control system (not shown) may be used to automatically control the operation of the system.

As shown best in FIGS. 10A, B and C, the plenum 44 includes a rectangular housing formed by four upright walls 58 and a top wall 60. A rectangular pedestal 59 is fastened to the top wall 60 and it serves as the support for the fan assembly 46 that removably fastens to it. All four walls 58 are constructed with identical panels 61 that can be selectively removed to orient the plenum 44 in any desired direction. When a panel 61 is removed, a large opening is formed in the plenum wall 58. A panel 61 is removed on one wall 58 to form the front to which a hood 62 is attached.

The hood 62 extends outwardly from the housing to provide a bypass air inlet 63 to the plenum 44. The hood 62 is formed by a pair of spaced vertical walls 64, a bottom wall 65, and a rain hood 66 which extends horizontally outward from the housing and then slopes downward. An upwardly-turned lip 68 is formed on the drip edge of the rain hood 66 to prevent water from dripping into the bypass air stream.

A damper 70 is mounted beneath the hood 62 to control the amount of ambient air that enters the plenum housing through the bypass air inlet 63. It includes damper blades that are controlled electronically or pneumatically to enable a flow of bypass air into the plenum 44 which maintains a constant total air flow into the fan assembly 46 despite changes in the volume of air exhausted from the building. Exhaust air from the building enters the plenum 44 through an exhaust inlet 71 formed in the bottom of the rectangular housing and mixes with the bypass air to produce once-diluted exhaust air that is drawn upward through an exhaust outlet 72' in the top of the pedestal 59 and into the fan assembly 46.

Figure 10B:
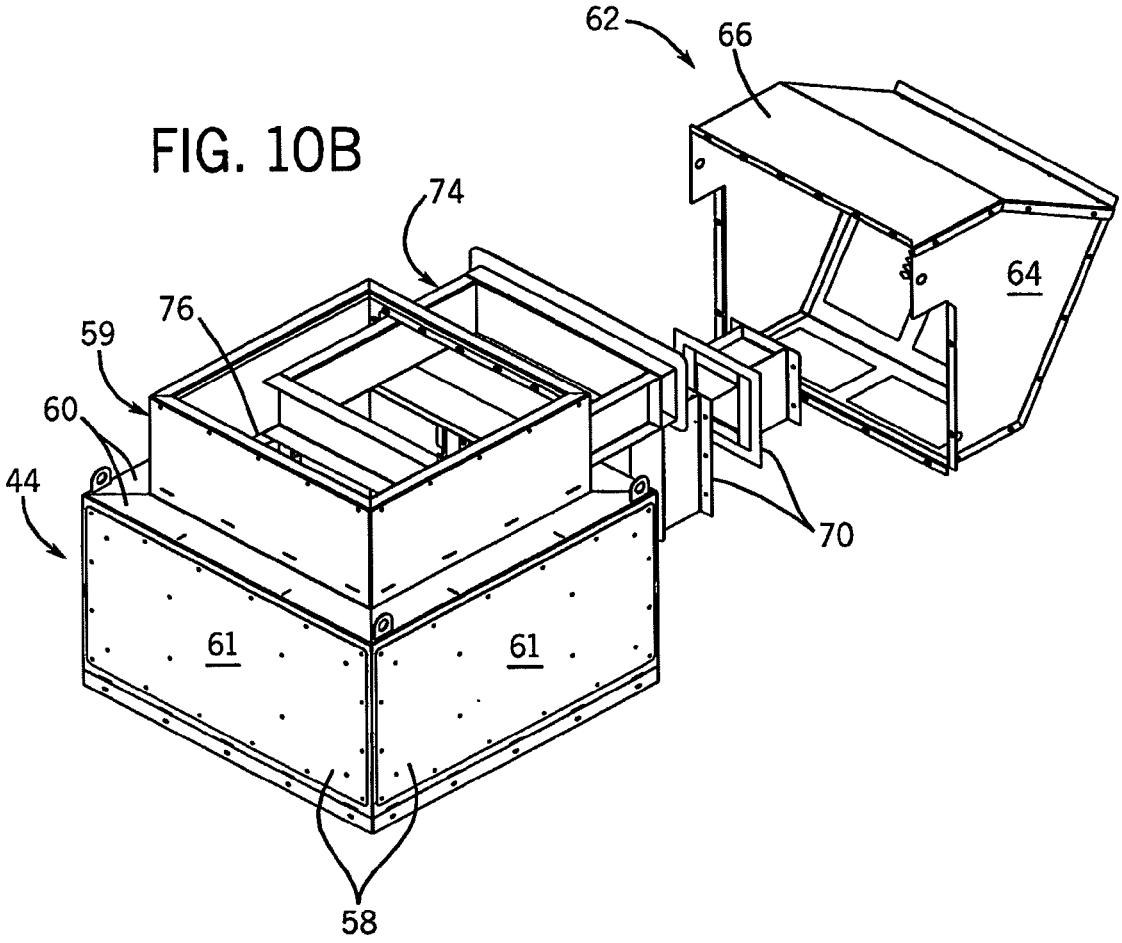
FIG. 10B is an exploded perspective view of the plenum of FIG. 10A.
Figure 10C:
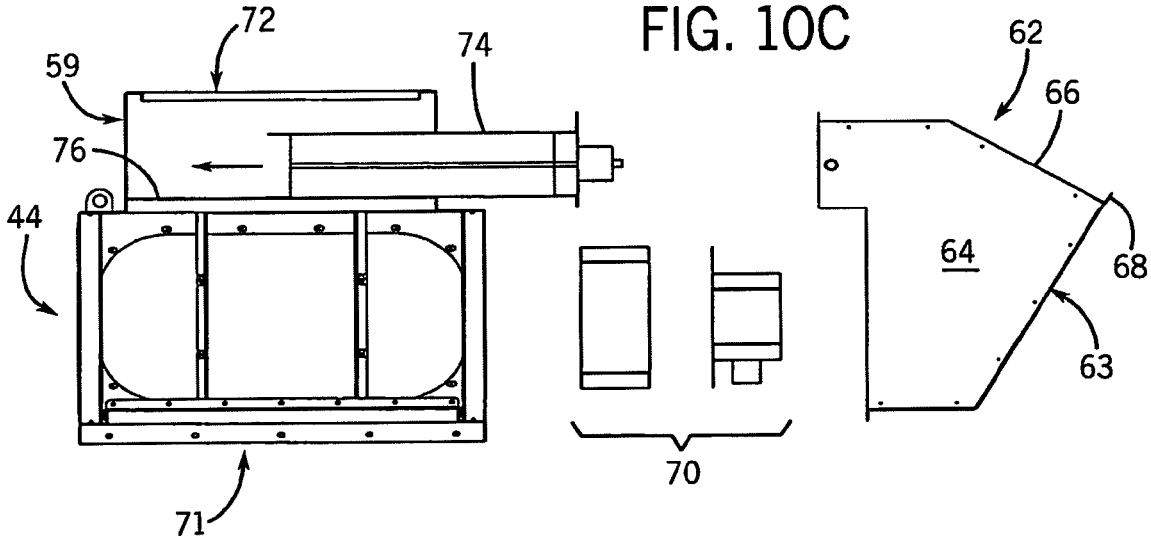
FIG. 10C is an exploded side view of the plenum of FIG. 10A with parts removed.

As shown best in FIGS. 10B and 10C, an isolation damper 74 is slidably mounted in the pedestal 59 just beneath the exhaust outlet 72. The isolation damper 74 is supported by a flange 76 formed around the interior of the pedestal 59, and it slides into place through the front wall of the pedestal. The isolation damper 74 serves to isolate the outdoor ambient air flowing downward through the fan assembly 46 when the fan is not operating. The isolation damper 74 has blades which are rotated by gravity, backdraft or a rotated shaft to close the damper when the fan is not operating. The isolation damper 74 may be easily removed for inspection or repair by disconnecting the hood 62 from the plenum 44 and sliding the damper 74 out of the pedestal 59.

Figure 11:
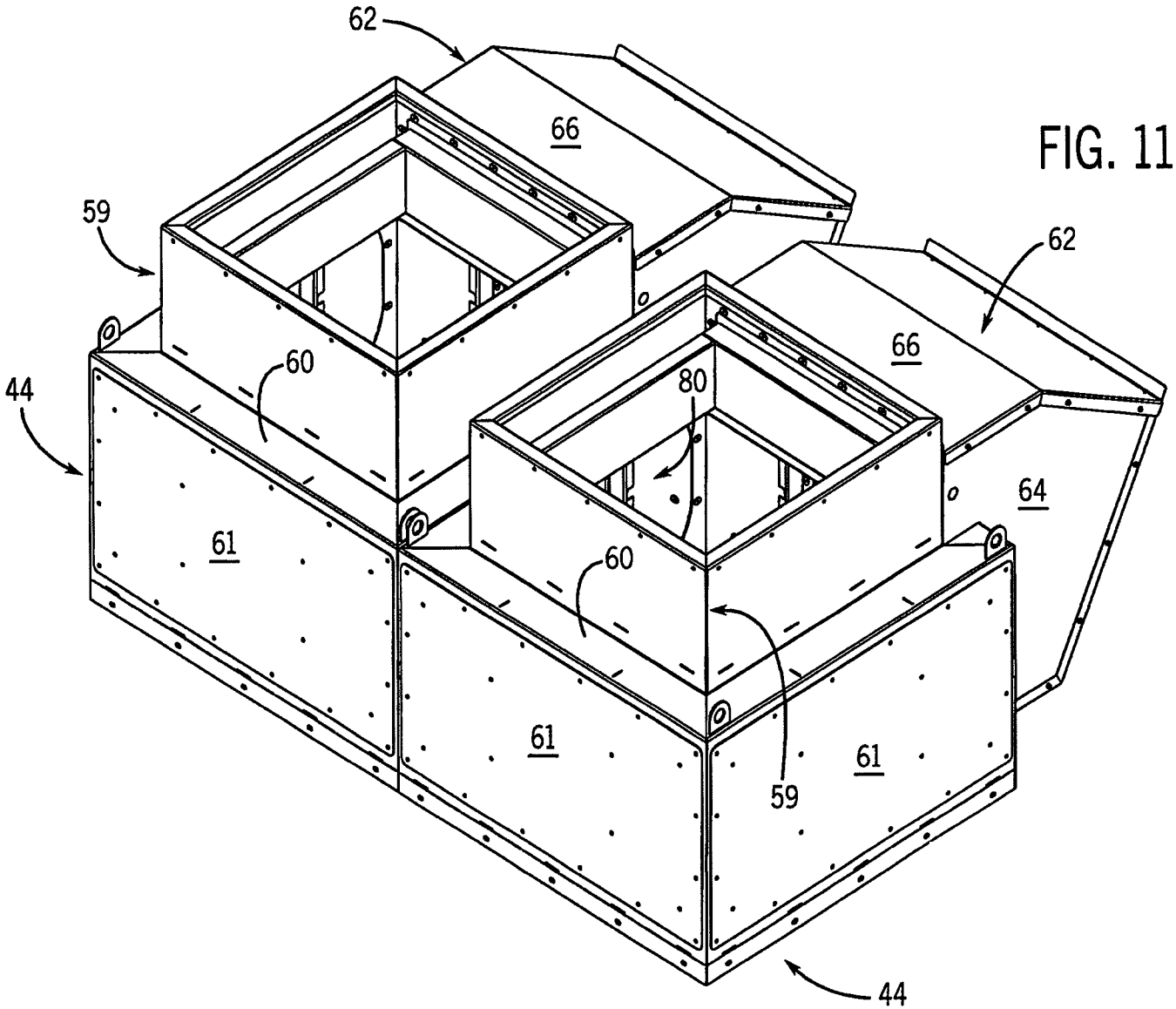
FIG. 11 is a perspective view of two plenums mounted side-by-side.

As shown best in FIG. 11, the removable panels 61 on the sides of the plenum 44 also enable multiple plenums 44 to be combined with a single riser 38. In this configuration the plenums 44 are mounted next to one another and the panels 61 in their abutting walls 58 are removed to form a single, enlarged chamber 80 defined by their combined housings. Any number of plenums 44 may be combined in this manner and complete flexibility in their orientation and the location of their hoods 62 is provided by the same removable panels 61 and mounting holes on all four walls 58 of the plenum 44.

Referring particularly to FIG. 2, the fan assembly 46 is removably mounted on top of the plenum 44. The fan assembly 44 has a rectangular base plate 102 with a downward-extending skirt that fits snuggly around the top edge of the rectangular pedestal 59. Fasteners attach this skirt to the top of the pedestal 59, and by removing these fasteners, the entire fan assembly 46 can be removed for repair or inspection.

The removable panels 61 also enable access to the interior of the plenum 44 from any direction. This enables routine maintenance and repairs to be made without having to remove the entire exhaust fan assembly 42 from the riser 38 or the fan assembly 46 from the plenum 44. Also, in many installations it is advantageous for the building exhaust air to be brought into the plenum 44 through one of its side walls 58 rather than the bottom. In such installations the appropriate panel 61 is removed to form the exhaust inlet to the plenum 44 and the bottom of the plenum housing is enclosed with a bottom wall (not shown in the drawings).

Figure 3:
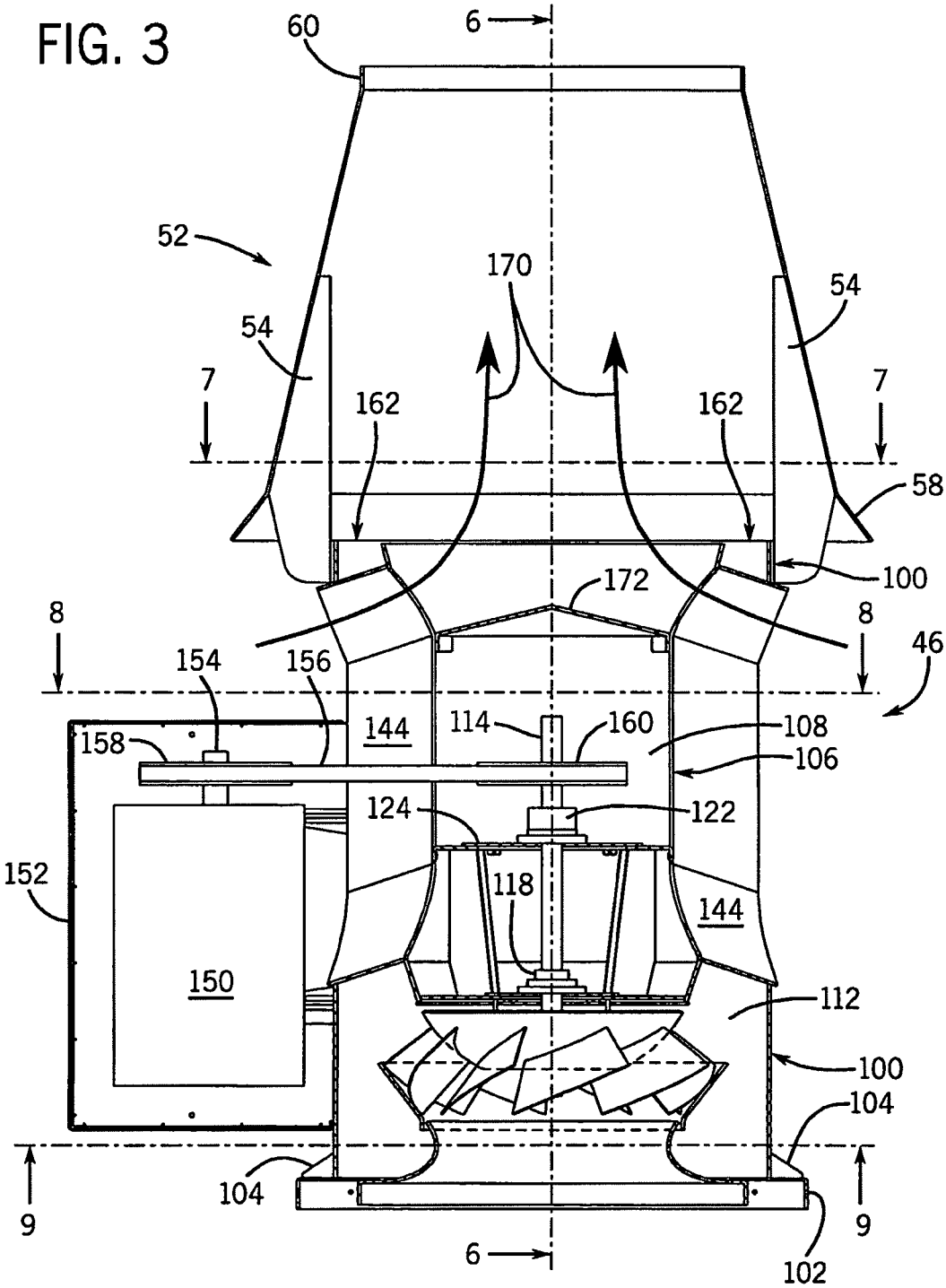
FIG. 3 is a sectional side elevation view of the exhaust fan assembly illustrated in FIG. 2.
Figure 4:
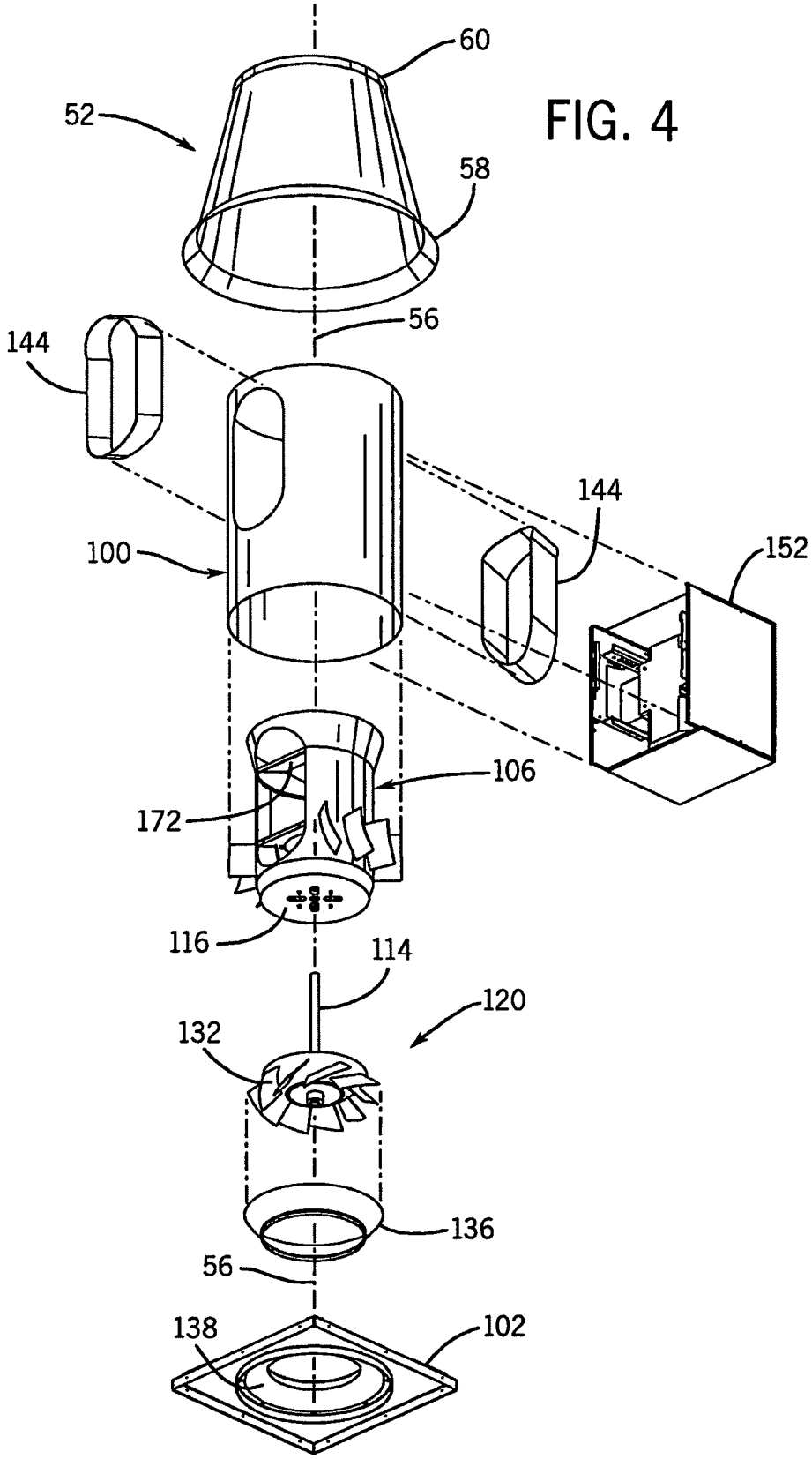
FIG. 4 is an exploded perspective view of the fan assembly of FIG. 3.
Figure 6:
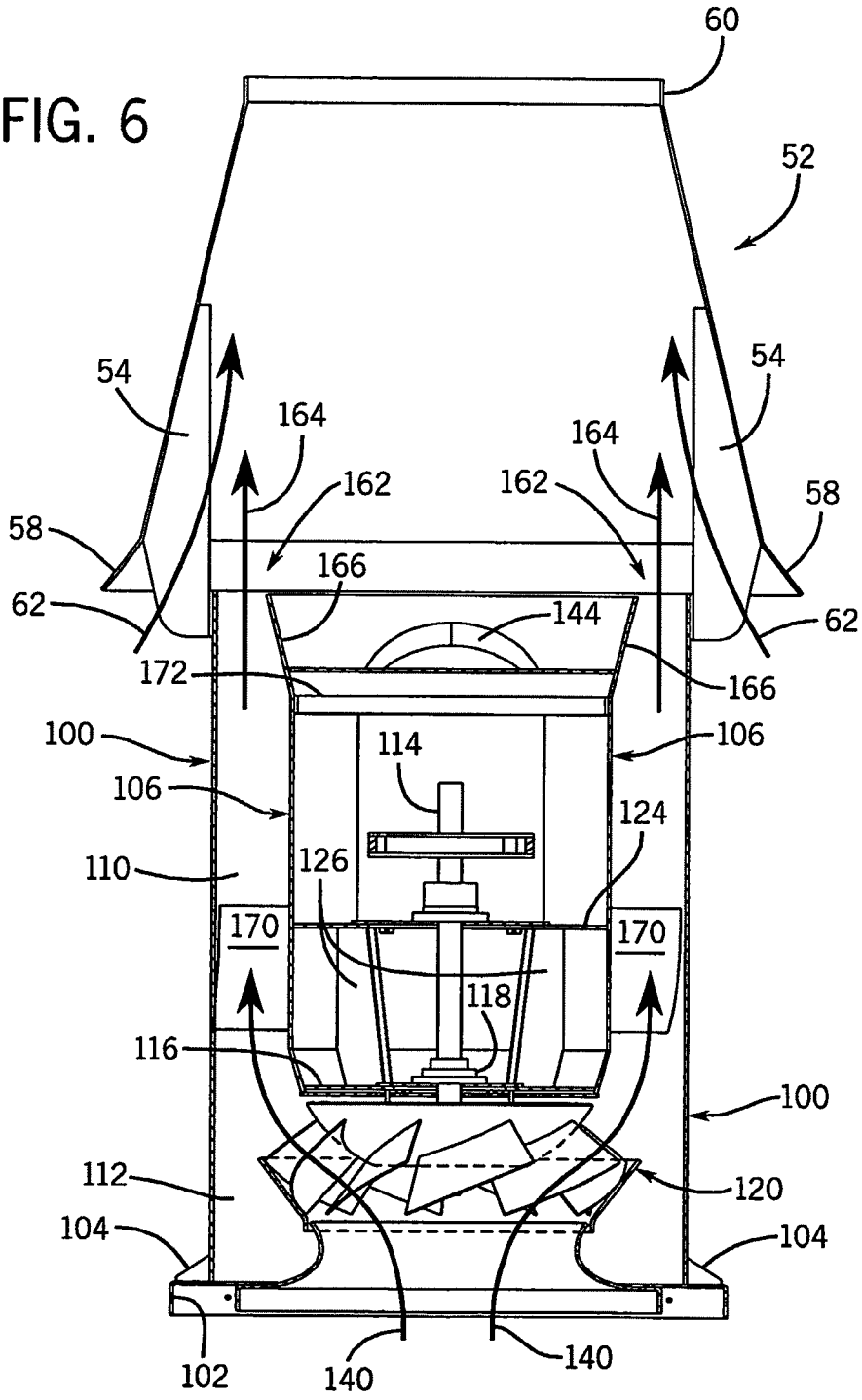
FIG. 6 is a view in cross-section taken along the plane 6-6 shown in FIG. 3.
Figure 7:
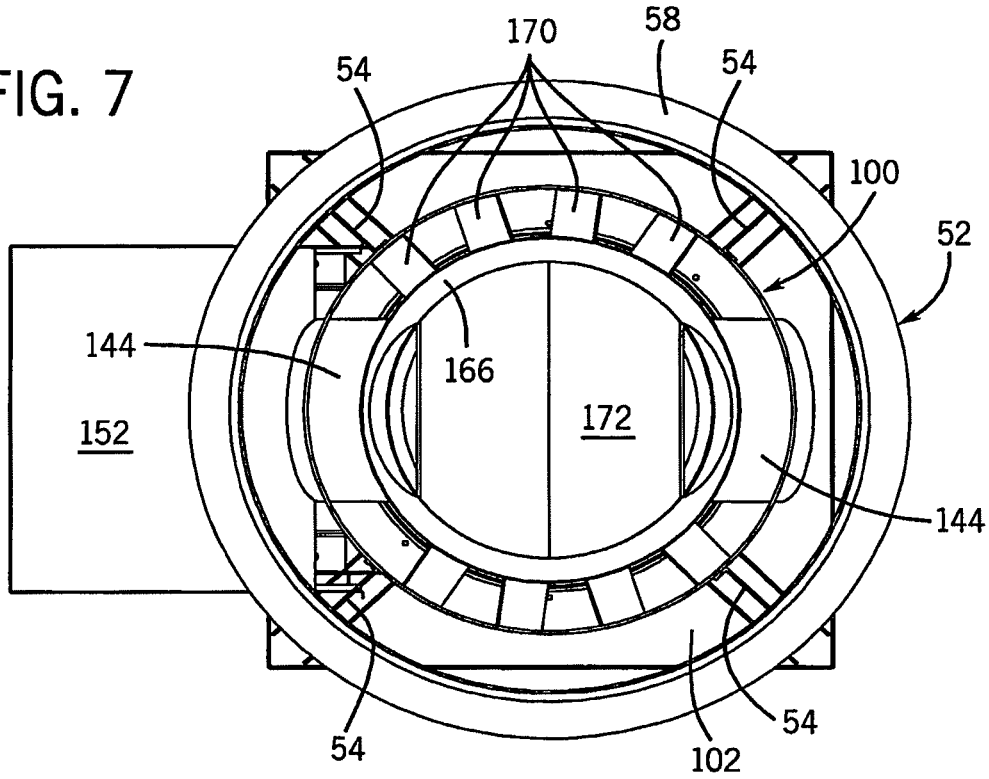
FIG. 7 is a view in cross-section taken along the plane 7-7 shown in FIG. 3.

Referring particularly to FIGS. 3, 4 and 6 the fan assembly 46 sits on top of the plenum 44 and includes a cylindrical outer wall 100 that is welded to the rectangular base plate 102. A set of eight gussets 104 are welded around the lower end of the outer wall 100 to help support it in an upright position although the number of gussets 104 may differ depending on fan size. Supported inside the outer wall 100 is a cylindrical shaped inner wall 106 which divides the chamber formed by the outer wall 100 into three parts: a central bearing chamber 108, a surrounding annular space 110 located between the inner and outer walls 106 and 100, and a fan chamber 112 located beneath the inner wall 106.

A fan shaft 114 is disposed in the bearing chamber 108 and is rotatably fastened by a bearing 118 to a bottom plate 116 welded to the bottom end of the inner wall 106. The fan shaft 114 extends downward into the fan chamber 112 to support a fan wheel 120 on its lower end, and it extends upward into the bearing chamber 108 where it is rotatably supported by an upper bearing 122. The upper bearing 122 fastens to a horizontal plate 124 that extends across the interior of the bearing chamber 108 and is supported from below by a set of gussets 126 spaced around the interior of the bearing chamber 108.

Figure 5:
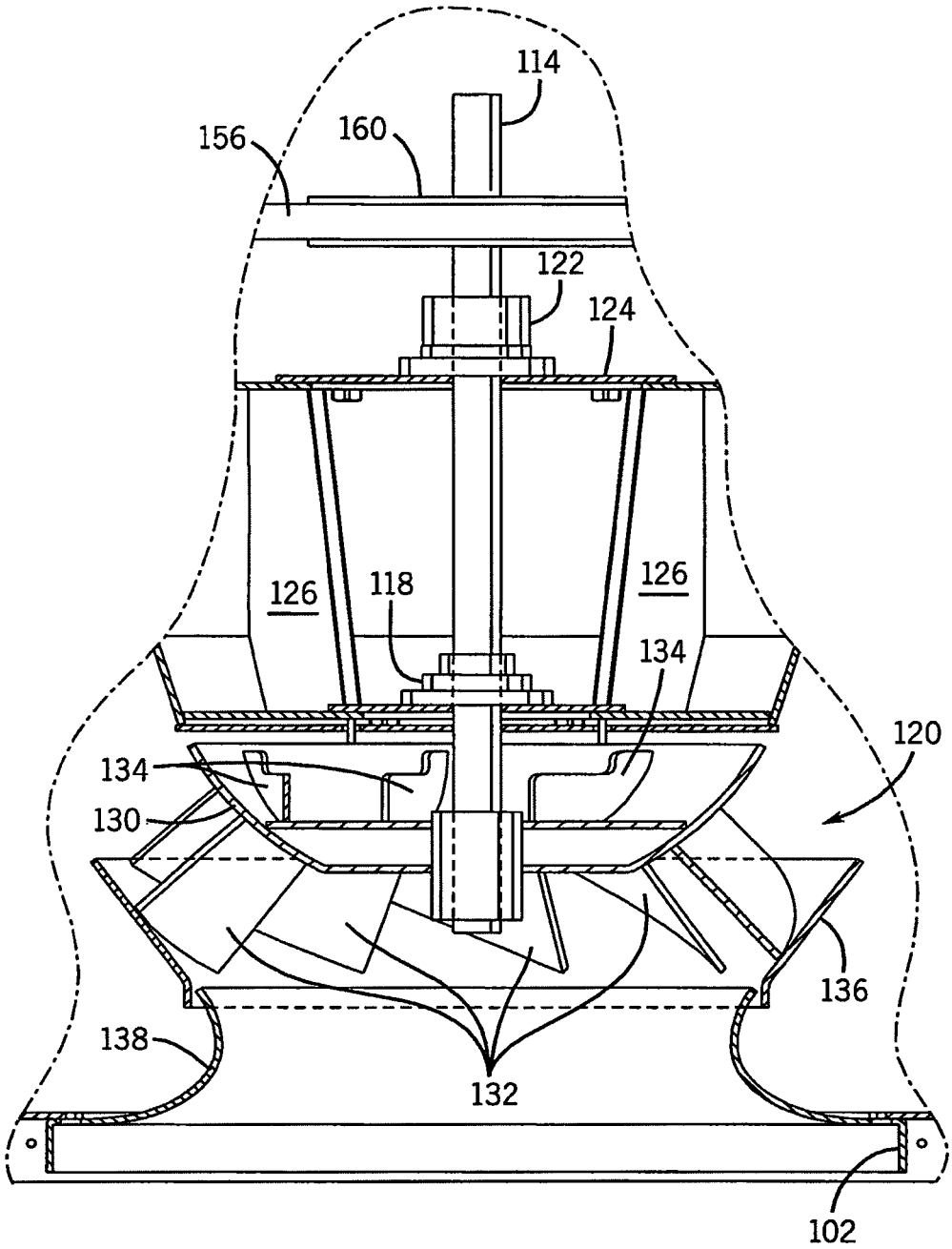
FIG. 5 is a partial view of the fan assembly of FIG. 3 with parts cut away.

Referring particularly to FIGS. 4 and 5, the fan wheel 120 includes a dish-shaped wheelback 130 having a set of main fan blades 132 fastened to its lower surface, and a set of auxiliary fan blades 134 fastened to its upper surface. The main fan blades 132 support a frustum-shaped rim 136 that extends around the perimeter of the fan blades. The lower edge of this rim 136 fits around a circular-shaped upper lip of an inlet cone 138 that fastens to, and extends upward from the base plate 102. The fan wheel 120 is a mixed flow fan wheel such as that sold commercially by Greenheck Fan Corporation under the trademark MODEL QEI and described in pending U.S. patent application Ser. No. 10/297,450 which is incorporated herein by reference. When the fan wheel 120 is rotated, exhaust air from the plenum 44 is drawn upward through the air inlet formed by the inlet cone 138 and blown radially outward and upward into the annular space 110 as shown by arrows 140.

Referring particularly to FIG. 5, the auxiliary fins 134 on the top surface of the fan wheel 130 produce a radially outward directed air flow. Since the shaft 114 and lower bearing 118 should provide a good seal with the bottom plate 116, no source of air should be available and this air flow is not well defined. However, if a leak should occur, an air flow pattern is established in which air is drawn from the bearing chamber 108 and directed radially outward through a gap formed between the upper rim of the fan wheel 130 and the bottom plate 116. As a result, exhaust air cannot escape into the bearing chamber 108 even if a leak should occur.

Access to the bearing chamber 108 from outside the fan assembly 46 is provided by two passageways formed on opposite sides. As shown best in FIGS. 3, 4 and 6, each passageway is formed by aligned elongated openings formed through the outer wall 100 and inner wall 106 which are connected by a passage wall 144. The passage wall 144 encircles the passageway and isolates it from the annular space 110 through which it extends. As shown best in FIG. 6 one can look through either of the passageways and see the fan shaft 114 and associated bearings 118 and 122. Maintenance personnel thus have easy access to these elements for inspection and repair.

Referring particularly to FIG. 3, the passageways into the bearing chamber 108 also enable a fan drive motor 150 to be located outside the fan assembly 46 and coupled to the fan shaft 114 through one of the passageways. In the preferred embodiment the motor 150 is enclosed in a motor cover 152 and mounted to the outer wall 100 with its shaft 154 oriented vertically. The motor shaft 154 is coupled to the fan shaft 114 by a belt 156 that extends around pulleys 158 and 160 on the respective shafts 154 and 114. In an alternative embodiment described in co-pending U.S. patent application Ser. No. 10/924,532 entitled "Pivotal Direct Drive Motor For Exhaust Assembly", the motor 150 is located in the bearing chamber 108 and its shaft is coupled directly to the fan shaft. In this embodiment the passageways allow access to the motor 150 for inspection, repair and replacement.

Figure 8:
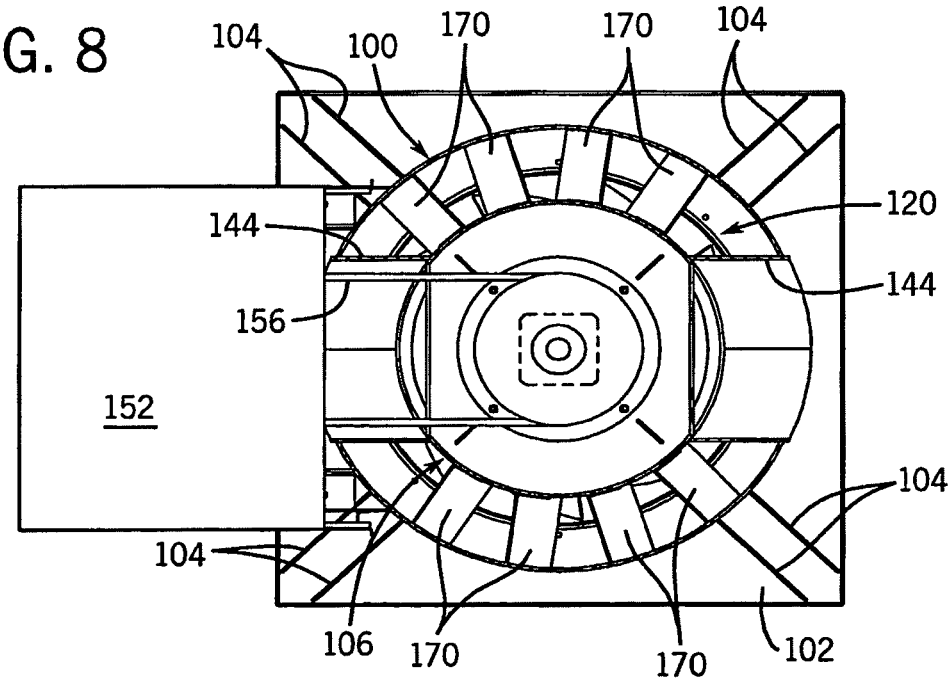
FIG. 8 is a view in cross-section taken along the plane 8-8 shown in FIG. 3.

Referring particularly to FIGS. 3, 4 and 6, the exhaust air moves up through the annular space 110 and exits through an annular-shaped nozzle 162 formed at the upper ends of walls 100 and 106 as indicated by arrows 164. The nozzle 162 is formed by flaring the upper end 166 of inner wall 106 such that the cross-sectional area of the nozzle 162 is substantially less than the cross-sectional area of the annular space 110. As a result, exhaust gas velocity is significantly increased as it exits through the nozzle 162. As shown best in FIGS. 6 and 8, vanes 170 are mounted in the annular space 110 around its circumference to straighten the path of the exhaust air as it leaves the fan and travels upward. The action of vanes 170 has been found to increase the entrainment of ambient air into the exhaust as will be described further below.

Referring particularly to FIGS. 4 and 6, a windband 52 is mounted on the top of the fan assembly 46 and around the nozzle 162. A set of brackets 54 are attached around the perimeter of the outer wall 100 and these extend upward and radially outward from its top rim and fasten to the windband 52. The windband 52 is essentially frustum-shaped with a large circular bottom opening coaxially aligned with the annular nozzle 162 about a central axis 56. The bottom end of the windband 52 is flared by an inlet bell 58 and the bottom rim of the inlet bell 58 is aligned substantially coplanar with the rim of the nozzle 162. The top end of the windband 52 is terminated by a circular cylindrical ring section 60 that defines the exhaust outlet of the exhaust fan assembly 42.

Referring particularly to FIG. 6, the windband 52 is dimensioned and positioned relative to the nozzle 162 to entrain a maximum amount of ambient air into the exhaust air exiting the nozzle 162. The ambient air enters through an annular gap formed between the nozzle 162 and the inlet bell 58 as indicated by arrows 62. It mixes with the swirling, high velocity exhaust exiting through nozzle 162, and the mixture is expelled through the exhaust outlet at the top of the windband 52.

A number of features on this system serve to enhance the entrainment of ambient air and improve fan efficiency. The flared inlet bell 58 at the bottom of the windband 52 has been found to increase ambient air entrainment by several percent. This improvement in air entrainment is relatively insensitive to the angle of the flare and to the size of the inlet bell 58. The same is true of the ring section 60 at the top of the windband 52. In addition to any improvement the ring section 60 may provide by increasing the axial height of the windband 52, it has been found to increase ambient air entrainment by 5% to 8%. Testing has shown that minor changes in its length do not significantly alter this performance enhancement.

It has been discovered that ambient air entrainment is maximized by minimizing the overlap between the rim of the nozzle 162 and the bottom rim of the windband 52. In the preferred embodiment these rims are aligned substantially coplanar with each other such that there is no overlap.

Another feature which significantly improves fan system operation is the shape of the nozzle 162. It is common practice in this art to shape the nozzle such that the exhaust is directed radially inward to "focus" along the central axis 56. This can be achieved by tapering the outer wall radially inward or by tapering both the inner and outer walls radially inward to direct the exhaust towards the central axis 56. It is a discovery of the present invention that ambient air entrainment can be increased and pressure losses decreased by shaping the nozzle 162 such that exhaust air is directed radially outward rather than radially inward towards the central axis 56. In the preferred embodiment this is achieved by flaring the top end 166 of the inner wall 106. Air entrainment is increased by several percent and pressure loss can be reduced up to 30% with this structure. It is believed the increase in air entrainment is due to the larger nozzle perimeter that results from not tapering the outer wall 100 radially inward. It is believed that the reduced pressure loss is due to the fact that most of the upward exhaust flow through the annular space 110 is near the outer wall 100 and that by keeping this outer wall 100 straight, less exhaust air is diverted, or changed in direction by the nozzle 162.

Referring particularly to FIG. 3, ambient air is also drawn in through the passageways and mixed with the exhaust air as indicated by arrows 170. This ambient air flows out the open top of the flared inner wall 100 and mixes with the exhaust emanating from the surrounding nozzle 162. The ambient air is thus mixed from the inside of the exhaust.

As shown in FIGS. 3, 4, 6 and 7, to protect the fan drive elements in the bearing chamber 108 from the elements, a sloped roof 172 is formed above the top end of the fan shaft 114. The roof 172 seals off the bearing chamber 108 from the open top end of the inner wall 106, and it is sloped such that rain will drain out the passageways. While this is not an issue while the fan is running, precipitation and other objects can fall into the fan assembly when it is idle.

Figure 14:
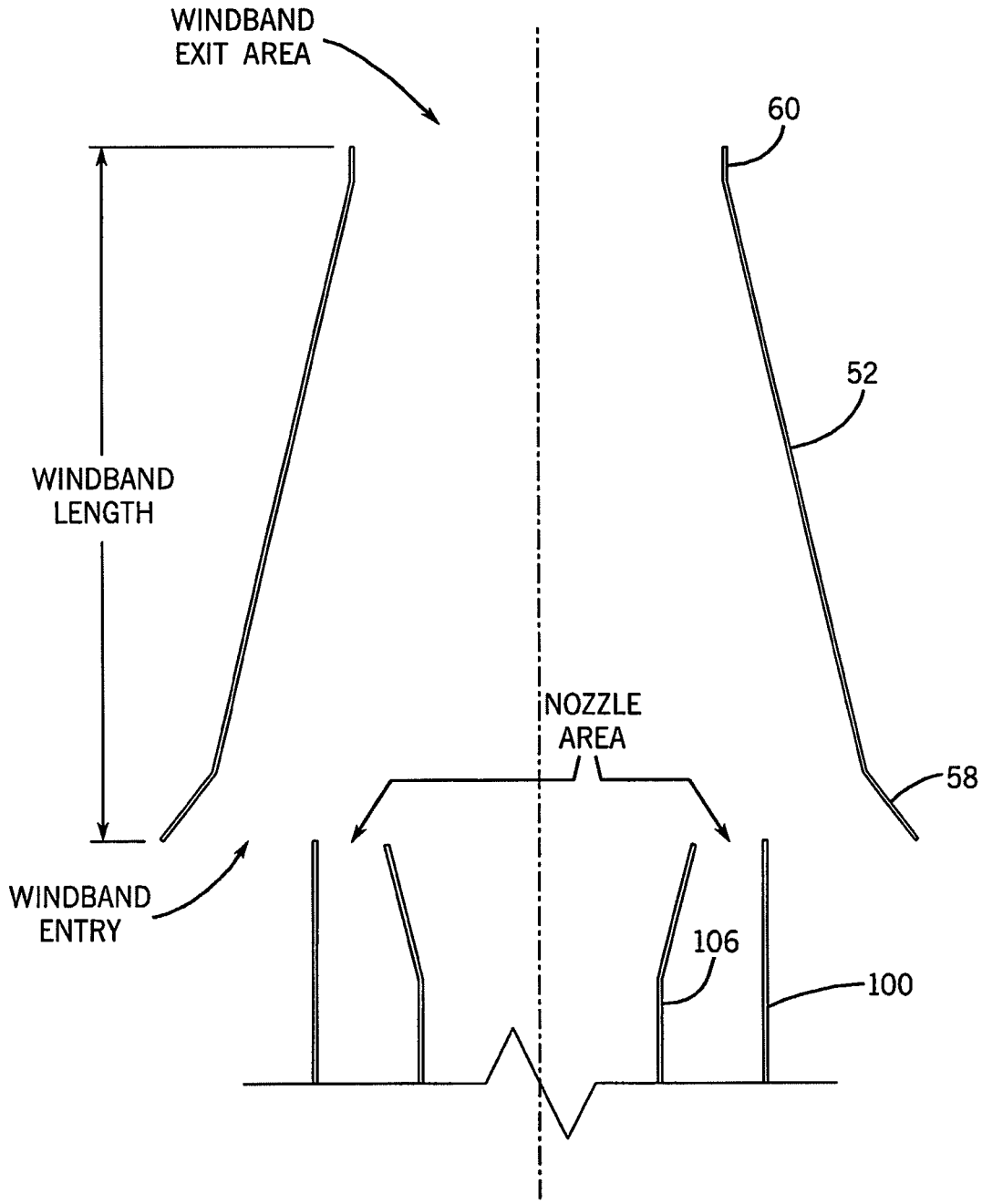
FIG. 14 is a schematic diagram of the fan assembly showing the parameters which determine the desired performance.

In addition to the performance enhancements discussed above, the structure of the exhaust fan assembly lends itself to customization to meet the specific needs of users. Such user specifications include volume of exhaust air, plume height, amount of dilution with ambient air, and assembly height above roof top. User objectives include minimizing cost, maximizing performance, and maximizing safety. Such customization is achieved by selecting the size, or horsepower, of the fan motor 150, and by changing the four system parameters illustrated in FIG. 14.

Nozzle Exit Area:

Increasing this parameter decreases required motor HP, decreases ambient air entrainment, decreases plume rise. Decreasing this parameter increases required motor HP, increases ambient air entrainment, increases plume rise.

Windband Exit Area:

Increasing this parameter increases ambient air entrainment, does not significantly affect plume rise or fan flow. Decreasing this parameter decreases ambient air entrainment, does not significantly affect plume rise or fan flow.

Windband Length:

Increasing this parameter increases ambient air entrainment, increases plume rise, does not affect fan flow. Decreasing this parameter decreases ambient air entrainment, decreases plume rise, does not affect fan flow.

Windband Entry Area (Minor Effect)

Increasing this parameter increases ambient air entrainment, increases plume rise, does not affect fan flow. Decreasing this parameter decreases ambient air entrainment, decreases plume rise, does not affect fan flow.

For example, for a specified system, Table 1 illustrates how windband length changes the amount of entrained ambient air in the exhaust and Table 2 illustrates how windband exit diameter changes the amount of ambient air entrainment.

TABLE 1

| Windband Length | Dilution |
|---|---|
| 39 inch | 176% |
| 49 inch | 184% |
| 59 inch | 190% |

TABLE 2

| Windband Exit Diameter | Dilution |
|---|---|
| 17 inch | 165% |
| 21 inch | 220% |
| 25 inch | 275% |

Table 3 illustrates how the amount of entrained ambient air changes as a function of nozzle exit area and Table 4 illustrates the relationship between the amount of entrained ambient air and windband entry area.

TABLE 3

| Nozzle Exit Area | Dilution |
|---|---|
| .79 $ft^2$ | 120% |
| .52 $ft^2$ | 140% |
| .43 $ft^2$ | 165% |

TABLE 4

| Windband Entry Area | Dilution |
|---|---|
| 10.3 $ft^2$ | 176% |
| 12.9 $ft^2$ | 178% |

In Tables 1-4 the dilution is calculated by dividing the windband exit flow by the flow through the fan assembly.

Figure 12:
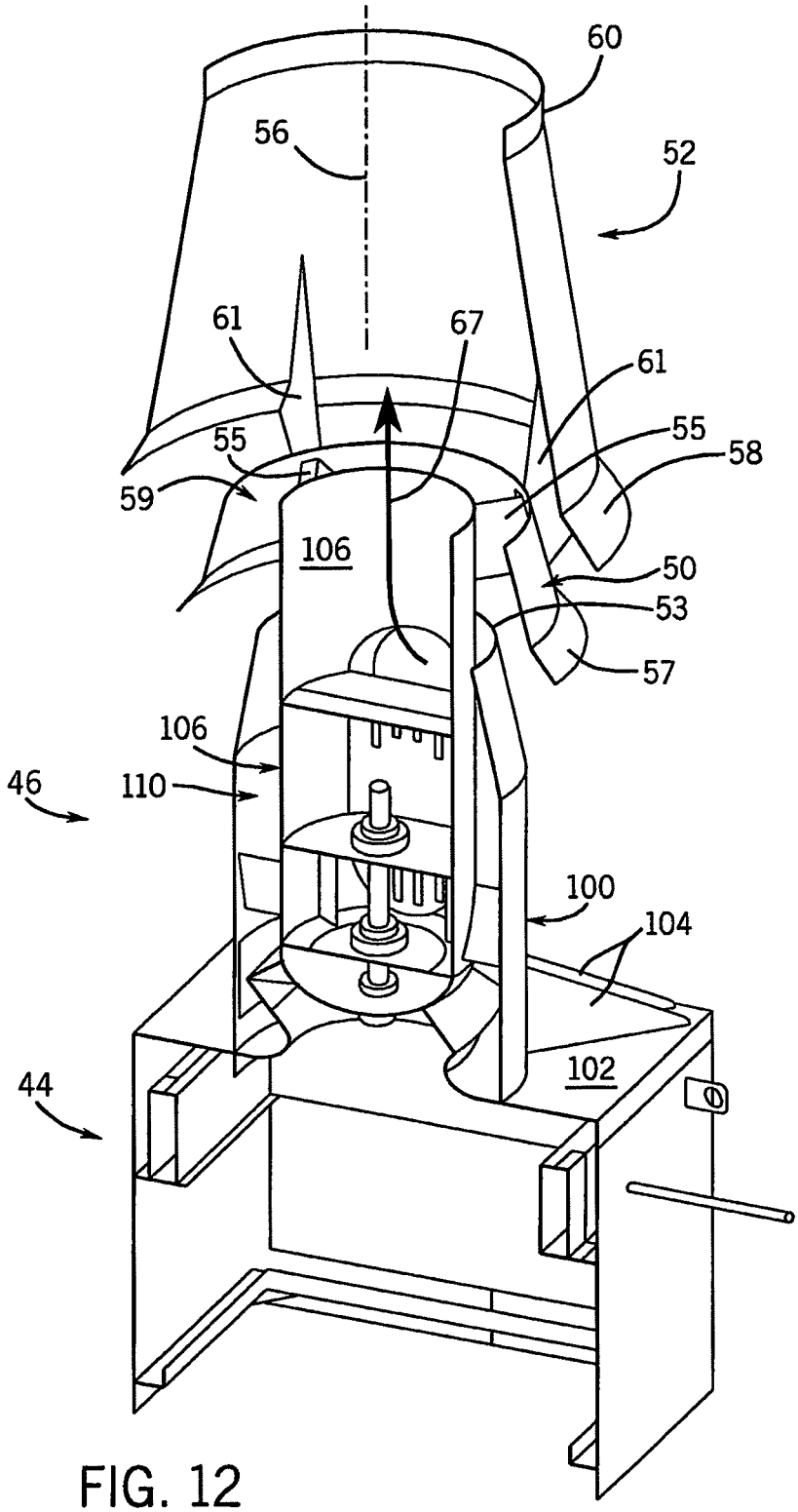
FIG. 12 is a pictorial view with parts cut away of a second embodiment of the exhaust fan assembly of the present invention.
Figure 13:
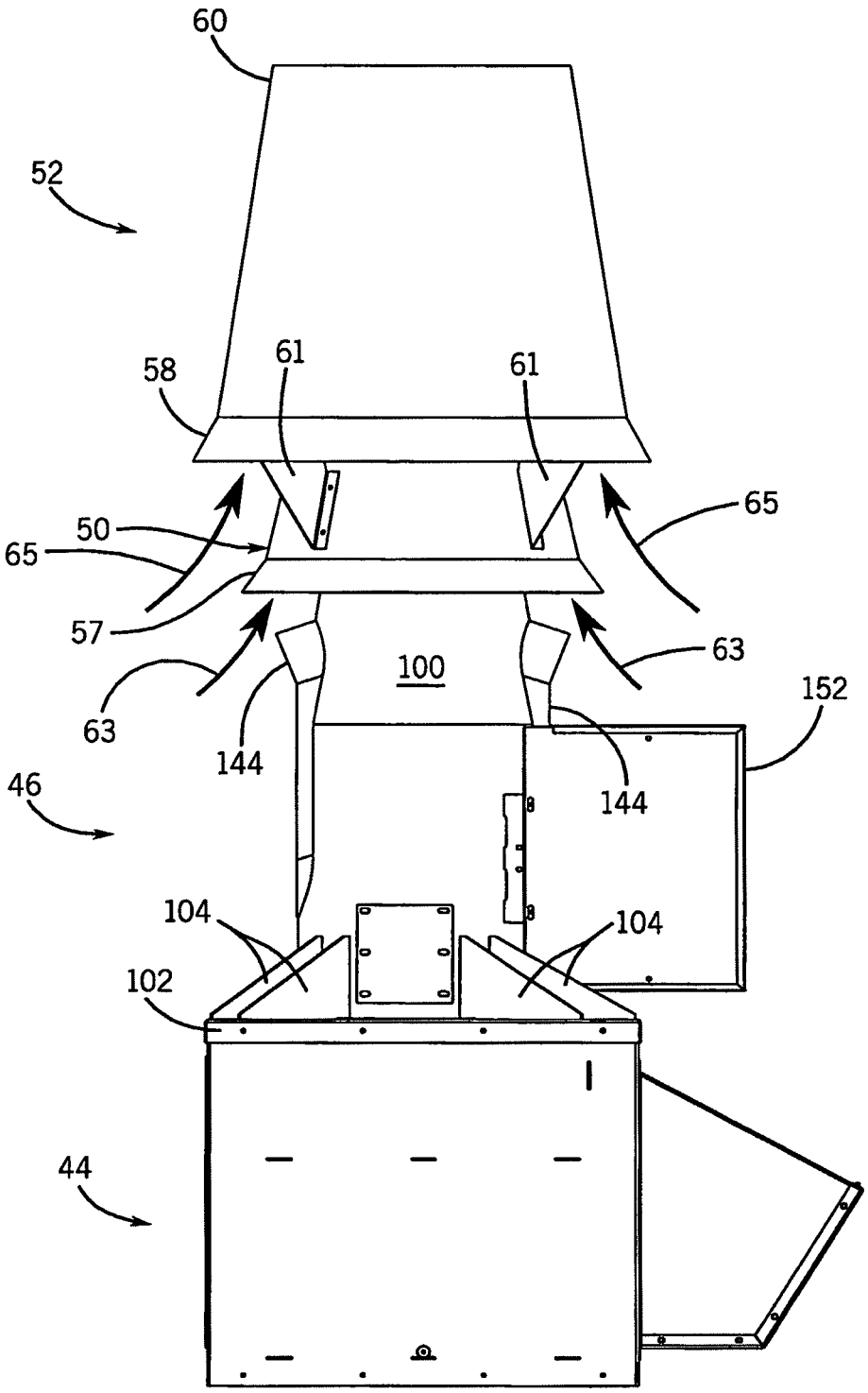
FIG. 13 is an elevation view of the exhaust fan assembly of FIG. 12.

Referring particularly to FIGS. 12 and 13, an alternative embodiment of the invention is substantially the same as the preferred embodiment described above except the nozzle end of the fan assembly 46 is modified to add an additional, second nozzle assembly 50. In this second embodiment the outer wall 100 of the fan assembly is tapered radially inward at its upper end to form a first nozzle 53 with the inner wall 106 which extends straight upward, beyond the nozzle 53. The second nozzle assembly 50 is a frustum-shaped element which is fastened to the extended portion of the inner wall 106 by brackets 55. It is flared around its bottom end to form an inlet bell 57 similar to that on the windband 52. The second nozzle assembly 50 is concentric about the inner wall 106, and its top end is coplanar with the top end of the inner wall 106 to form an annular-shaped second nozzle 59 therebetween. Brackets 61 fasten around the perimeter of the second nozzle assembly 50 and extend upward and radially outward to support the windband 52. The windband 52 is also aligned coaxial with the inner wall 106 and second nozzle assembly 50 and its lower end is substantially coplanar with the top end of the second nozzle 59. In this alternative embodiment it is also possible to form the first nozzle 53 by flaring the inner wall 106 outward rather than tapering the outer wall 100.

Referring particularly to FIG. 13, the annular space between the lower end of the second nozzle assembly 50 and the outer wall 100 forms a first gap through which ambient air enters as indicated by arrows 63. This air is entrained with the exhaust air exiting the first nozzle 53 to dilute it. Similarly, the annular space between the lower end of the windband 52 and the second nozzle assembly 50 forms a second gap through which ambient air enters as indicated by arrows 65. This air is entrained with the once diluted exhaust air exiting the second nozzle 59 to further dilute the exhaust. As with the first embodiment, further ambient air which enters through passageways 144 and flows out the top end of the inner wall 106 as shown in FIG. 12 by arrow 67 also dilutes the exhaust before it is expelled at high velocity out the exhaust outlet at the top of the windband 52.

We claim:

1. An exhaust fan assembly comprising:

a substantially cylindrical outer enclosed wall having an air inlet and an air outlet, the outer enclosed wall including at least one elongated opening extending along the majority of a side between the air inlet and outlet;

an inner enclosed wall being positioned within the outer enclosed wall and including at least one elongated opening;

an annular space defined between the inner enclosed wall and the outer enclosed wall, wherein an upper end of the inner enclosed wall flares outward toward the outer enclosed wall so as to constrict the annular space to form a nozzle;

a windband mounted to the outer enclosed wall, the windband having a tapered body defining an inlet having a circular opening;

a roof and a bottom plate secured to the inner enclosed wall, wherein the roof, the bottom plate, and the inner enclosed wall define a bearing chamber;

a fan disposed within the outer enclosed wall and upstream of the bearing chamber, the fan being configured to move exhaust air through the air inlet, the annular space and the air outlet, the fan being configured to move ambient air through an inlet of the windband to an outlet of the windband;

a rotatably mounted shaft connected to the fan, the shaft extending through the bottom plate and into the bearing chamber; and a passage wall extending between the elongated openings of the inner and outer enclosed walls, the openings and passage wall together forming a service passageway for access from the exterior of the assembly to the bearing chamber and forming an air passageway for a volume of ambient air to be drawn into the air passageway, into the inner enclosed wall, and out of the windband substantially surrounded by exhaust air, without the volume of ambient air entering the bearing chamber, and wherein the service passageway and bearing chamber are configured to prevent exhaust air from entering the bearing chamber from the annular space.

2. The exhaust fan assembly of claim 1, wherein the windband inlet opening includes a flared portion that extends radially outward at an angle greater than that of an angle of the tapered body with respect to a longitudinal axis of the windband.

3. The exhaust fan assembly of claim 1, further comprising a fan motor connected to the rotatably mounted shaft.

4. The exhaust fan assembly of claim 3, wherein the fan motor is a direct drive motor located within the bearing chamber, the motor being serviceable through the service passageway.

5. The exhaust fan assembly of claim 4, wherein the fan motor is connected to the rotatably mounted shaft by a belt extending into the service passageway.

6. The exhaust fan assembly of claim 1, further comprising a second passageway formed by a second passage wall extending between second elongated openings of the inner and outer enclosed walls.

7. The exhaust fan assembly of claim 1, wherein the roof protects the bearing chamber from substances entering the top end of the inner enclosed wall.

8. The exhaust fan assembly of claim 1, wherein the fan includes auxiliary blades, the auxiliary blades being constructed to draw air from the bearing chamber to the fan chamber, and to blow the air radially outward into the annular space.

9. The exhaust fan assembly of claim 1, wherein the windband inlet opening is coplanar with the top of the nozzle.

10. An exhaust fan assembly comprising:

a substantially cylindrical outer enclosed wall having an air inlet and an air outlet, the outer enclosed wall including at least one elongated opening extending along the majority of a side between the air inlet and outlet;

an inner enclosed wall being positioned within the outer enclosed wall and including at least one elongated opening;

an annular space defined between the inner enclosed wall and the outer enclosed wall, the annular space being constricted to form a nozzle;

a windband mounted to the outer enclosed wall, the windband having a tapered body defining an inlet having a circular opening that includes a flared portion that extends radially outward at an angle greater than that of an angle of the tapered body with respect to a longitudinal axis of the windband;

a roof and a bottom plate secured to the inner enclosed wall, wherein the roof, the bottom plate, and the inner enclosed wall define a bearing chamber;

a fan disposed within the outer enclosed wall and upstream of the bearing chamber, the fan being configured to move exhaust air through the air inlet, the annular space and the air outlet, the fan being configured to move ambient air through an inlet of the windband to an outlet of the windband;

a rotatably mounted shaft connected to the fan, the shaft extending through the bottom plate and into the bearing chamber; and a passage wall extending between the elongated openings of the inner and outer enclosed walls, the openings and passage wall together forming a service passageway for access from the exterior of the assembly to the bearing chamber and forming an air passageway for a volume of ambient air to be drawn into the air passageway, into the inner enclosed wall, above the roof, and out of the windband;

wherein the service passageway is configured to prevent exhaust air from entering the bearing chamber from the annular space, and wherein the service passageway and bearing chamber are configured to prevent the volume of ambient air from entering the annular space.

11. An exhaust fan assembly comprising:

a substantially cylindrical outer enclosed wall having an air inlet and an air outlet, the outer enclosed wall including at least one elongated opening extending along the majority of a side between the air inlet and outlet;

an inner enclosed wall being positioned within the outer enclosed wall and including at least one elongated opening;

an annular space defined between the inner enclosed wall and the outer enclosed wall, the annular space being constricted to form a nozzle;

a windband mounted to the outer enclosed wall, the windband having a tapered body defining an inlet having a circular opening that is coplanar with the top of the nozzle;

a roof and a bottom plate secured to the inner enclosed wall, wherein the roof, the bottom plate, and the inner enclosed wall define a bearing chamber;

a fan disposed within the outer enclosed wall and upstream of the bearing chamber, the fan being configured to move exhaust air through the air inlet, the annular space and the air outlet, the fan being configured to move ambient air through an inlet of the windband to an outlet of the windband;

a rotatably mounted shaft connected to the fan, the shaft extending through the bottom plate and into the bearing chamber; and a passage wall extending between the elongated openings of the inner and outer enclosed walls, the openings and passage wall together forming a service passageway for access from the exterior of the assembly to the bearing chamber and forming an air passageway for a volume of ambient air to be drawn into the air passageway, above the roof, and out of the windband;

wherein the service passageway is configured to prevent exhaust air from entering the bearing chamber from the annular space, and wherein the service passageway and bearing chamber are configured to prevent the volume of ambient air from entering the annular space.

* * * * *